United States Patent [19]

Zimmerman

[11] 4,337,765

[45] Jul. 6, 1982

[54] MOUTHGUARD

[76] Inventor: Edgar S. Zimmerman, 631 Newman Springs Rd., P.O. Box 216, Lincroft, N.J. 07738

[21] Appl. No.: 210,824

[22] Filed: Nov. 26, 1980

[51] Int. Cl.[3] ..... A63B 23/00

[52] U.S. Cl. ..... 128/136

[58] Field of Search ..... 128/136, 132 R

[56] References Cited

U.S. PATENT DOCUMENTS

| | | | |
|---|---|---|---|
| 2,643,652 | 6/1953 | Cathcart | 128/136 |
| 2,996,908 | 1/1961 | Cathcart et al. | 128/136 |
| 3,016,052 | 1/1962 | Zubren | 128/136 |
| 3,457,916 | 7/1969 | Wolicki | 128/136 |
| 3,496,936 | 2/1970 | Gores | 128/136 |
| 3,518,988 | 7/1970 | Gores | 128/136 |
| 3,864,832 | 2/1975 | Carlson | 128/136 |
| 4,044,762 | 8/1977 | Jacobs | 128/136 |
| 4,185,817 | 1/1980 | Peterson | 128/136 |

OTHER PUBLICATIONS

"Reduction of Stress in the Chewing Mechanism—Part III" by W. B. May, D.D.S., *Basal Facts,* vol. 3, No. 1, pp. 22–28, (Jul. 1978).

*Primary Examiner*—Henry J. Recla

*Attorney, Agent, or Firm*—Bernard, Rothwell & Brown

[57] ABSTRACT

A mouthguard comprises a member formed of a resilient material and having an approximately U-shape corresponding generally to the shape of the arch of the upper jaw. The member includes a bottom wall designed to engage the lower teeth and spaced side walls or flanges extending upwardly therefrom and forming a cavity for receiving the upper teeth. Laterally the bottom wall comprises an approximately planar surface of sufficient width to extend laterally the full width of the lower teeth and engage both the buccal and the lingual cusps of the lower teeth. The bottom wall is formed to include a portion of greater thickness in the molar-bicuspid region, and a portion of maximum thickness in the region engaging the lower first molar. As the jaw closes, the jaw tends to pivot about the lower first molar, causing a slightly increased separation between the condyle of the mandible and the temporal bone and minimizing any damage caused by force transmitted in the temporomandibular joint area.

11 Claims, 8 Drawing Figures

MOUTHGUARD

BACKGROUND OF THE INVENTION

1. Field of the Invention

This invention relates to mouthguards and particularly to mouthguards adapted for minimizing shock to the teeth and head area.

2. Description of the Prior Art

There are a number of different types of mouthguards presently available on the market but they have deficiencies which prevent their giving optimum protection to the wearer against serious injuries to the teeth and particularly to the head and neck area.

For example, many mouthguards consist simply of U-shaped trough-like members of resilient material, such as rubber or suitable plastic, shaped to fit over the upper or lower teeth or both. In the case of many such mouthguards, a blow to the lower jaw may result in one or more teeth penetrating through the mouthguard structure and, more importantly, such mouthguards provide little, if any, protection against head and neck injuries.

One prior art mouthguard is formed to provide a bottom wall which increases in thickness from the posterior to the anterior area, this increase in thickness being such as to conform to the normal angle of approach of the upper and lower jaws in the act of closing the mouth and thereby to ensure engagement of the mouthguard by the incisors of the lower jaw simultaneously with the molars thereof. Because of the construction and hinging of the lower jaw, the movement of the forward portion thereof relative to the rear portion during opening and closing of the mouth is approximately a three-to-one ratio. This prior art structure is apparently intended to have a gradually increasing thickness toward the forward portion so as to correspond generally to this ratio and to thereby provide an even distribution of contact over all the teeth. As will be explained later in describing the invention of the present application, this even distribution of contact cannot accomplish the beneficial results of the applicant's invention.

Another prior art structure involves a mouthpiece with a triangular-shaped ridge depending from the lower wall thereof in the molar-bicuspid area. In this structure, the depending ridge has a relatively sharp edge which is intended to engage the lower teeth in the central area between the buccal and lingual cusps, that is, in the fossa of the lower teeth. In the case of this structure, as the triangular ridge is compressed as a result of a blow to the lower jaw, it spreads somewhat against the sides of the cusps, creating an undesirable lateral force. Moreover, in the case of many individuals, the teeth are not in direct line and the straight edge of the ridge in that case would engage not the fossa but the inner or outer inclined walls of the cusps, depending on the direction of misalignment of each individual tooth, again creating undesirable lateral force and defeating the purpose of the mouthguard.

Normally, the head of the condyle of the mandible articulates with a cartilagenous disk or movable cartilagenous pad in the temporomandibular joint, and it is this pad which glides between the condylar head of the mandible and the articular surface of the glenoid fossa of the temporal bone. In wearing conventional mouthguards, the athlete is not only subject to potential damage to the teeth but, more importantly, to damage resulting from direct transmittal of force through the mandible, the thin layer of cartilage, and into the temporal bone and the cranial cavity. Substantial increases in intracranial pressure and cranial bone deformation have been shown to occur when a football player, for example, receives a blow on the chin or on the faceguard of the protective helmet. This results in a measurable deformation of the skull. Similar damage occurs in other contact sports, such as, boxing, hockey, soccer, lacrosse, etc. Because of the use of protective helmets with faceguards for intercepting horizontal blows, the principal injuries to football players in the head area result from upward blows to the lower jaw, especially the chin area, and upward blows to the faceguard which transmit force to the jaw through the chin strap.

By the present invention these limitations and deficiencies of the prior art mouthguards have been overcome and not only is protection provided against damage to the teeth, but the mouthguard is constructed so as to provide an increased separation between the mandible and the glenoid fossa and to slightly increase this separation in the case of a blow to the chin or faceguard and thereby to avoid transmission of damaging force from the condyle of the mandible to the temporal bone and the cranium.

Accordingly, it is a primary object of the present invention to provide a protective mouthguard designed to provide an orthopedic placement of the mandible relative to the cranium and, more specifically, relative to the glenoid fossa of the temporal bone with which it articulates.

It is a further object of this invention to provide not only a cushioning against upward forces but also to provide a pivoting action about a fulcrum point in the molar area to cause a slight rocking shock absorption motion.

It is a further object of this invention to minimize stresses to the incisor teeth and to provide for easier breathing and speaking while wearing the mouthguard.

It is still another object of this invention to provide a mouthguard which functions effectively despite irregularities in the upper dental arch and in the plane of occlusion between the upper and lower jaws and teeth.

It is still a further object of this invention to provide a mouthguard in a limited number of sizes which are suitable for fitting substantially all mouth sizes and teeth characteristics and which may be fitted by the athlete without the necessity of custom-fitting by a dentist.

It is another object of this invention to provide a mouthguard which may be standardized in a limited number of sizes for commercial production and economically produced.

It is a further object of this invention to provide a mouthguard which will protect the temporomandibular joint against trauma.

SUMMARY OF THE INVENTION

In carrying out this invention, in one form thereof, the mouthguard comprises a member formed of a resilient material and having an approximately U-shape corresponding generally to the shape of the arch of the upper jaw. The member includes a bottom wall designed to engage the lower teeth and spaced side walls or flanges extending upwardly therefrom and forming a cavity for receiving the upper teeth. Laterally the bottom wall comprises an approximately planar surface of sufficient width to extend laterally the full width of the lower teeth and engage both the buccal and the lingual cusps of the lower teeth. The bottom wall is formed to include a portion of greater thickness in the molar-bicuspid region, and more particularly in the region generally extending from the second molar through the first bicuspid. The lower surface of this thicker portion is shaped to follow approximately the normal dental Curve of Spee found between the upper and lower dental arches. Not only is a greater thickness of cushioning material present between opposing sets of teeth in the molar-bicuspid region to give a better cushioning effect, but the mouthguard of this invention is constructed with a portion of maximum thickness in the region which engages the lower first molar so that the mouthguard initially engages the lower teeth in this region. Thus, as the jaw closes further, the jaw tends to pivot about this fulcrum point, thereby causing a slightly increased separation between the condyle of the mandible and the temporal bone and minimizing any damage caused by force transmitted in the temporomandibular joint area. Further, because of this portion of increased thickness and the location of the pivot point, a blow on the chin tends to increase the separation at the temporomandibular joint, thereby further minimizing transmission of force to this joint and to the cranial area.

The anterior portion of the mouthguard is recessed or offset superiorly to minimize stresses to the incisor teeth (which, being single-rooted, are more prone to fracture), to allow freer pivotal action and to provide for easier breathing and speaking when the mouthguard is being worn. The anterior portion of the mouthguard may include a depending element adapted to engage the lower incisor teeth when the mouthguard is being fitted to the teeth, this depending element being thereafter snipped off.

The mouthguard is intended to be provided in two forms. In one form it would be custom-fitted to the wearer by a dentist. In the other form, which is designed to be fitted by the user, a somewhat softer material would be provided in the cavity of the mouthguard and the user could install the mouthguard over the upper teeth so as to cause the upper teeth to be impressed into this softer material.

DESCRIPTION OF THE PREFERRED EMBODIMENT

Figure 1:
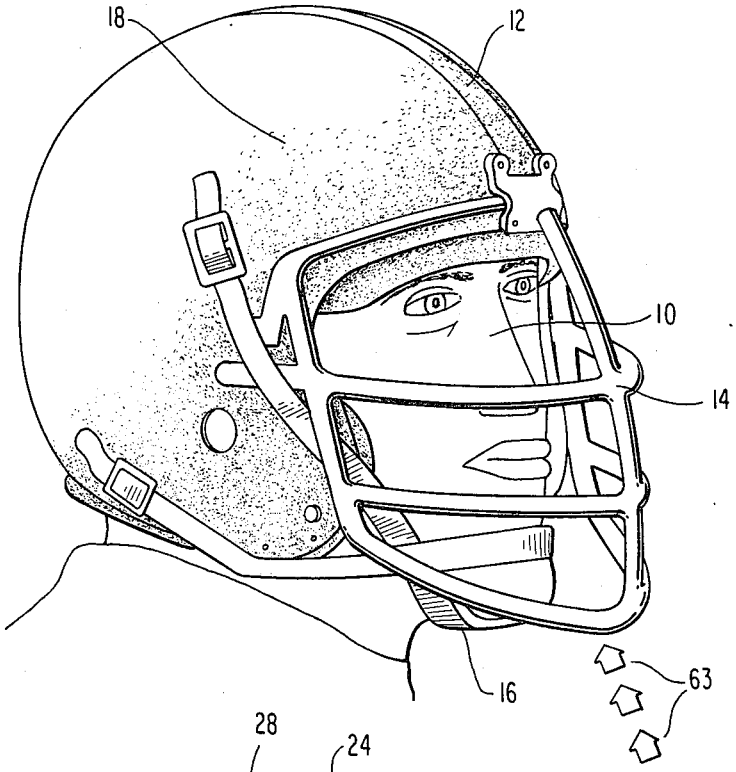
FIG. 1 is a view of a human head with a conventional football helmet thereon.

Referring first to FIG. 1, there is shown a representation of a human head 10 with a conventional football helmet 12 thereon. The helmet includes a protective cage or faceguard 14 for protecting the facial area and a chin strap 16 for holding the helmet in place. Despite the protective aspects of the conventional helmet, a blow to the chin or to the chin strap area or an upward blow to the faceguard is still capable of causing significant damage, not only to the teeth, but to the cranial area indicated generally at 18.

Figure 2:
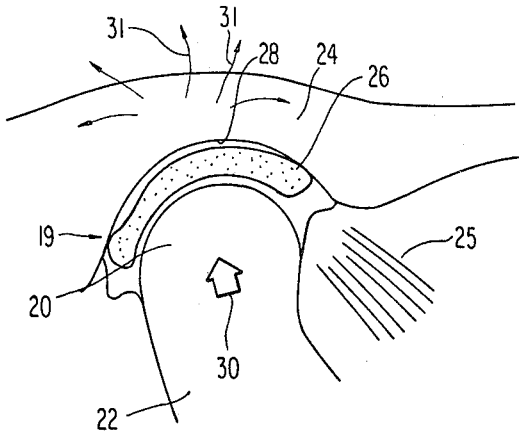
FIG. 2 is an enlarged view of the temporomandibular joint area, illustrating the application of force thereto.

The nature of the potential damage associated with such blows to the chin or faceguard area can be better appreciated by reference to FIG. 2. This figure illustrates the temporomandibular joint 19 formed between the condyle 20 of the mandible or lower jaw 22 and the temporal bone 24, the movement at the lower jaw being controlled by muscles shown generally at 25. A cartilagenous disk or pad 26 is disposed between the condyle and the glenoid fossa 28 of the temporal bone. The head of the condyle 20 articulates with the cartilagenous disk or pad 26 in the temporomandibular joint and the cartilagenous disk or pad 26 glides between the condylar head of the mandible and the articular surface of the glenoid fossa of the temporal bone. With conventional mouthguards, the components of the temporomandibular joint are positioned as shown in FIG. 2. Under these circumstances a blow to the chin or upward blow to the faceguard causes a transmission of force in the direction of the arrow 30 into the temporomandibular joint and through the temporal bone into the cranial area, as generally indicated by the arrows 31. This not only causes potential damage to the joint itself but the force is transmitted to the cranium resulting in potential deformation in the cranial area indicated at 18 and damage to the brain, for example, concussion.

Figure 3:
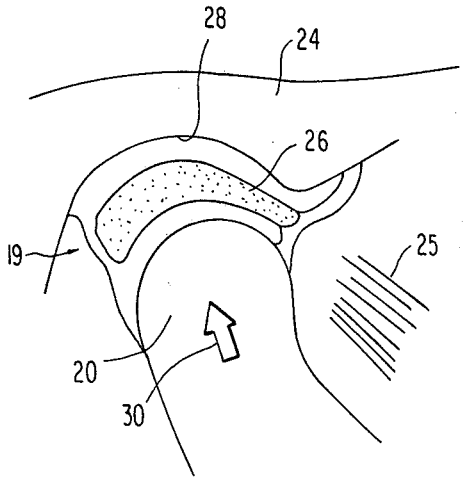
FIG. 3 is a view similar to FIG. 2 but illustrating the temporomandibular joint as affected by the mouthguard of this invention.

The mouthguard of this invention, as described in detail below, tends to cause a separation of the condyle 20 of the mandible relative to the temporal bone 24 as illustrated in FIG. 3. When a blow is received to the chin or faceguard with the mouthguard of this invention in place, any force in the direction of the arrow 30 has a significantly less damaging effect on the temporomandibular joint 19. Moreover, the separation of the bony parts of the temporomandibular joint, namely the condyle of the mandible and the temporal bone, prevents a damaging shock wave from being transmitted through the temporomandibular joint 19 to the brain and other underlying structures in the cranial area. Further, as will be explained in detail below, because of the construction of the mouthguard of this invention, such a blow tends to cause a greater rather than lesser separation at the temporomandibular joint 19 and thereby further reduces the potential damage.

Figure 4:
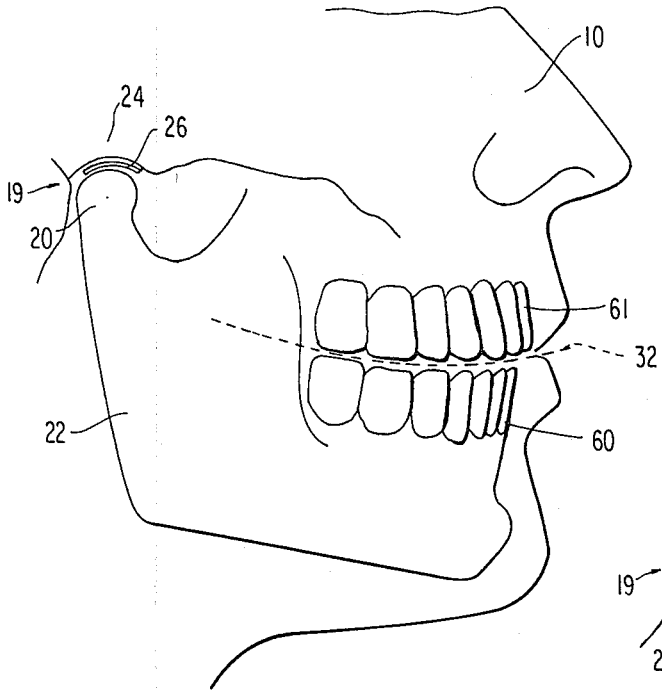
FIG. 4 is a profile view of a human head illustrating the general position of the teeth and of the temporomandibular joint.

Referring now to FIG. 4, there is shown an illustration of a portion of a human head 10 with sections broken away to illustrate the teeth and temporomandibular joint area. The dashed line 32 shown in FIG. 4 indicates the Curve of Spee which is a line generally extending between the upper and lower dental arches. The relationship of the components of the temporomandibular joint 19 shown in FIG. 4 correspond to those shown in enlarged form in FIG. 2.

Figure 5:
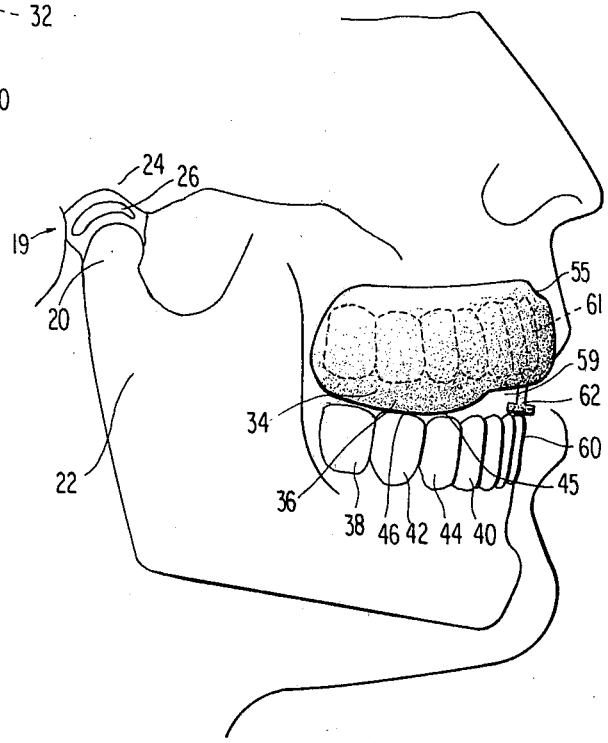
FIG. 5 is a view similar to FIG. 4 but showing the mouthguard of this invention and the different relationships resulting therefrom.

Turning now to FIG. 5, there is shown a view similar to FIG. 4 but with the mouthguard 34 of this invention shown superimposed on the upper teeth. The mouthguard 34 has a bottom wall of increased thickness in the region indicated at 36. Specifically, this greater thickness is in the region extending from the second molar 38 through the first bicuspid 40 and including the first molar 42 and the second bicuspid 44, that is, the portion of greater thickness extends in an anterior-posterior direction. Viewed laterally, the thickness is constant, that is, whatever the thickness is in a given tooth area, it is the same from the buccal side of the mouthguard to the lingual side. The lower surface 45 of the thicker portion 36 of the bottom wall 48 is shaped to follow approximately the Curve of Spee, but the bottom wall has its maximum thickness in the area positioned to contact the lower first molar. As shown in FIG. 5, as the jaw closes to the position there illustrated, the mouthguard initially contacts the lower teeth generally in the area of the lower first molar, as indicated by the numeral 46, and the lower jaw tends to pivot about this area 46 as the mouth is closed. It can be seen by reference to FIG. 5 that with this mouthguard construction, when the lower jaw has almost reached its closed position, the aforementioned pivoting effect has resulted in a slight separation in the area of the temporomandibular joint 19. This separation is shown in greater detail in the enlarged view of FIG. 3.

Figure 6:
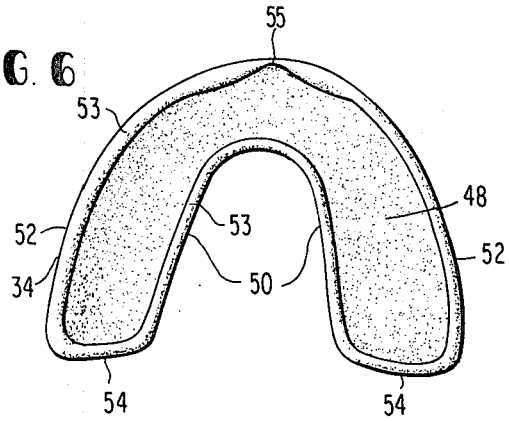
FIG. 6 is a plan view of the mouthguard of this invention.
Figure 7:
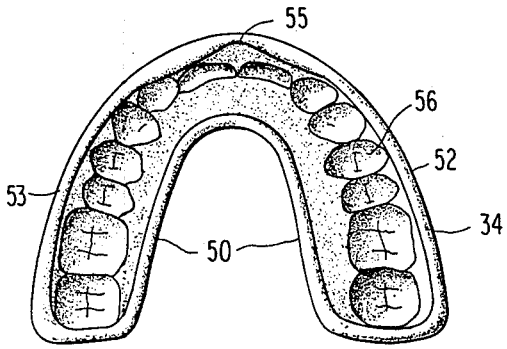
FIG. 7 is a view similar to FIG. 6 but showing impressions of the upper teeth therein.
Figure 8:
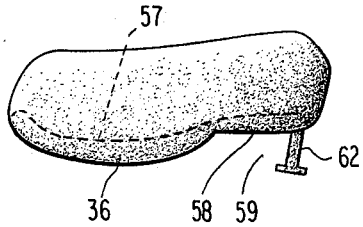
FIG. 8 is a side view of the mouthguard of this invention.

The mouthguard 34 of this invention is shown in greater detail in FIGS. 6, 7 and 8. Referring now to these figures, the mouthguard 34 is formed in an approximately U-shape corresponding generally to the shape of the dental arch of the upper jaw. The mouthguard 34 has a substantially U-shaped cross section and includes a bottom wall 48, an inner or lingual flange 50 extending upwardly from the bottom wall, and an outer or buccal flange 52 also extending upwardly from the bottom wall. The inner and outer flanges 50 and 52, respectively, are intended to conform generally to the lingual and buccal areas, respectively, of the upper teeth and gums, and each of the flanges end in a rounded edge 53 approximating the gingival tissues. The flanges 50 and 52 are connected at their posterior ends by transverse flanges 54. The buccal flange 52 is notched downwardly, as indicated at 55, to provide space for the superior labial frenum. The bottom wall 48 is generally flat in a lateral direction and is of greater width than the width of the lower teeth so as to extend fully across the surface of the lower teeth and slightly beyond these teeth on both the lingual side and the buccal side. This insures that the bottom wall engages both the lingual and buccal cusps of the molars and bicuspids. Moreover, the bottom wall is of such width as to contact the lower teeth across both the lingual and buccal sides even where there is variation in the width of the dental arch, or misalignment, as is often the case, of these lower teeth. This can be visualized from FIG. 7. Although this figure shows the impressions 56 of the upper teeth in the mouthguard rather than showing the lower teeth, the lower teeth are slightly inward of the upper teeth (the lingual cusps of the upper molars, for example, normally engage the fossa of the lower molars), and it can be visualized from FIG. 7 that the lower teeth would fall within the area of the bottom wall 48 of the mouthguard.

The side view of the mouthguard 34 shown in FIG. 8 further illustrates the construction of the mouthguard of this invention. As there shown, particularly by reference to the dashed line 57 which indicates the inner bottom surface of the cavity of the mouthguard, the bottom wall 48 has a portion of greater thickness in the region 36 which, as explained in connection with FIG. 5, extends from the second molar 38 through the first bicuspid 40. Forward of the region 36, the bottom of the mouthguard is recessed or offset upwardly, as indicated at 58, so as to provide a space 59 between the anterior portion of the mouthguard and the lower incisors 60. As indicated by the dashed line 57, the bottom wall of the mouthguard is of reduced thickness in the region 58. This recessed portion accomplished several functions. First, it allows a pivoting of the lower jaw about the fulcrum area indicated at 46 in FIG. 5 so as to provide a slight separation in the temporomandibular joint area. Secondly, it minimizes the possibility of damage to the upper incisors 61 and the lower incisors 60 in the event of a blow to the chin. Finally, it provides an assured breathing area when the mouthguard is in place, making the mouthguard more comfortable to wear, and also making it easier to speak clearly with the mouthguard in place.

In order to facilitate correct positioning of the mouthguard, particularly where this is done by the user rather than by a dentist or orthodontist, the mouthguard includes a positioning tab 62 formed to depend from the bottom wall of the mouthguard in the anterior region and positioned to engage the lower incisors 60. In order to ensure engagement with the lower incisors, the positioning tab is preferably formed in a T-shaped cross section as shown. After the mouthguard is properly fitted to the upper teeth, the positioning tab 62 is simply snipped off.

The effectiveness of the mouthguard in minimizing injury will be more clear by observing its operation when positioned properly in the mouth about the upper teeth, referring primarily to FIGS. 2, 3, 4 and 5. As indicated previously the lower surface 45 of the thicker portion 36 of the mouthguard is shaped to follow approximately the Curve of Spee, that is, a line generally following the line of occlusion between the upper and lower teeth, but the bottom wall 48 has its maximum thickness in the area 46 positioned to contact the lower first molar. When the lower jaw is closed, the lower teeth engage the thicker portion 36 of the mouthguard approximately at the first molar, as indicated by the numeral 46 in FIG. 5. Thereafter, as the lower jaw completes its closure, it tends to pivot about the fulcrum provided at the area 46, thereby effecting a slight separation in the temporomandibular joint, as can best be seen by comparing FIGS. 4 and 5 or, on a larger scale, comparing FIGS. 2 and 3. Because the bottom wall 48 of the mouthguard is, as described previously, relatively flat laterally and of a width sufficient to extend laterally beyond the lower teeth both buccally and lingually, the force between the mouthguard and the lower teeth is distributed relatively evenly laterally over the molars and over the bicuspids and not concentrated on any limited area of each of these teeth. In accordance with this invention, however, the force is initially not evenly distributed anteriorly and posteriorly because of the initial contact at the fulcrum area 46 and the pivoting movement about this fulcrum.

Unlike prior art mouthguards, when an upward blow in the general direction of the arrows 63 in FIG. 2 is received on the chin or faceguard of an individual using the mouthguard of this invention, because of the aforementioned separation in the temporomandibular joint, the force of the blow does not result in the transmission of shock waves through the temporomandibular joint to the brain and cranial area 18. Because of the separation in the temporomandibular joint area, possible damage to the temporomandibular joint itself from such a blow is minimized. Moreover, because of the pivoting about the area 46, as previously described, a blow to the chin also tends to slightly increase the separation in the temporomandibular joint, further reducing the transmission of force to and through this joint. The thicker material in the region 36 acts as a cushion and helps absorb force transmitted in a vertical direction, that is, along the long axis of the ramus and condyle of the mandible. Even though under a strong upward blow the entire jaw may move upwardly as the lower teeth are pressed into and cushioned by the mouthguard, unlike prior art structures this upward movement does not result in the transmission of damaging force to and through the temporomandibular joint, because the aforementioned pivoting action counteracts this upward movement at the temporomandibular joint, and the separation between the condyle and the temporal bone is slightly increased rather than reduced under the impact of the blow.

It is contemplated that the mouthguard of this invention will be provided in two forms. In one form, the mouthguard would be custom-fitted by a dentist or orthodontist, utilizing impressions of the upper and lower dental arches. In this form the mouthguard would be of unitary construction and made of a suitable material compatible with the oral tissues, for example a latex rubber or a synthetic plastic material of sufficient durability and density to maintain its form and function and having sufficient resiliency to provide the necessary cushioning effect. This form of the mouthguard would be made to conform to the upper dental arch of the prospective user and would include impressions of the upper teeth in the inside bottom wall of the mouthguard, as indicated in FIG. 7. The mouthguard could subsequently be installed in the correct position by the user with the upper teeth fitting in the previously-formed depressions.

The second form of the mouthguard is contemplated to be of the "do-it-yourself" variety. In this case, it is contemplated that the mouthguard would be made available commercially in three sizes, small, medium and large, which should be sufficient to fit, with adequate accuracy, essentially all mouths. The selected sizes are based on comprehensive studies by the dental profession of jaw and dental arch shapes and sizes occurring in a substantial number of individuals adequately representative of the population as a whole. In this form of the invention, the mouthguard may be made of unitary construction, as in the case of the first form just discussed or it may be of double-layered construction, including an outer shell of a material having the same characteristics as that of the unitary construction and an inner layer within the mouthguard made of moldable synthetic plastic material which the user would mold to the hard and soft structures of the upper dental arch. For example, the outer shell could be preformed of a suitable material and an inner layer could be made of a material which can be softened adequately by immersing in water at boiling temperature. In this case the outer shell is preferably made of a material which retains its shape when subjected to water at boiling temperature. The user, having selected the mouthguard of the proper size, would soften the inner layer by immersing the mouthguard in boiling water for a suitable length of time. The user would then fit the mouthguard, with the softened inner layer over the upper teeth in the position shown in the drawings and mold it against the upper teeth and gums so that these teeth are impressed into the softer layer of material forming the inside bottom wall 48. The material of the inner layer would then be allowed to cool and set in its final form. If desired, the shell could also be formed of a similar material which would soften to some degree when subject to boiling water, but still retain its shape, so that impressions of the lower teeth could also be formed therein during fitting by the user. Thereafter, the mouthguard can be installed in the mouth for regular use with the upper teeth being received in the formed impressions and with the lower teeth received in formed impressions if these are formed during fitting.

Alternatively, the mouthguard or the inner layer thereof could be formed of a material which is in a softened condition and which is caused to set after the impression is made by treating it within a proper temperature range. Also the inner layer could be made of a material which is soft enough to receive a proper impression but which then is caused to harden with the impression formed therein, by exposing it to air for a period of time.

When sold in the "do-it-yourself" form, it is contemplated that the mouthguard would include the positioning tab 62 to aid the user in properly fitting the mouthguard. This tab 62 helps the athlete in properly centering the mouthguard during fitting. It also aids the athlete in determining how far to close the mouth during fitting, thereby maintaining the proper spacing. Thereafter, the tab 62 would be snipped off to leave a smooth bottom surface in the anterior area of the mouthguard. The positioning tab 62 may also be included in the mouthguard which is professionally installed. The material of which the mouthguard is made can be cut by scissors, so that any portion which uncomfortably contacts the gum or cheek area can easily be cut off by the user. Similarly, any excess material of the inner layer can be easily trimmed.

In one specific embodiment of the mouthguard of this invention, the thickness of the bottom wall 48 is approximately 5 millimeters at the region 46 which is positioned to be engaged by the lower first molar. The portion of the mouthguard bottom wall extending posteriorly from the region 46 is approximately 4 millimeters thick and the portion extending anteriorly to and including the area of the lower first bicuspid is also approximately 4 millimeters thick. The recessed portion at 58 is approximately 2 millimeters thick.

It can be appreciated from the above description of the construction and operation of the mouthguard of this invention that it possesses a number of particular advantages. It provides a pivoting action in the molar area to allow a rocking shock absorption motion of the mandible. It provides a thicker pad of soft protective shock-absorbing material in the molar-bicuspid area. It provides a construction which automatically assures a slight separation in the temporomandibular joint and which minimizes both damage to this joint and the transmission of shock waves through the joint to the brain area. The upward offset of the mouthguard in the anterior area minimizes stresses to the upper and lower incisor teeth, allows a freer pivotal action, thereby further minimizing potential damage, and provides for easy breathing and speaking. Finally, the mouthguard readily adapts itself to irregularities in the occlusion between the upper and lower jaws and the upper and lower teeth and to asymmetries of the dental arch.

In addition to the above advantages, experimental results have indicated that wearing of the mouthguard of this invention appears to result in an increase in strength. Several individuals have found that they can press an additional amount of weight and have more endurance when wearing the mouthguard of this invention. The applicant has been told by athletes who have used the mouthguard of this invention that when they resumed use of conventional mouthguards, their front teeth hurt from the pressure, presumably because of the absence of the recess of the applicant's structure at the anterior portion.

While a specific form of the mouthguard of this invention has been illustrated and described, modifications may be made in the details of the structure without departing from the substance of the invention. For example, while specific dimensional relationships of a preferred embodiment have been set forth, these specific dimensions may be varied to some extent so long as a portion of greater thickness is provided in the molar-bicuspid area. Also while the portion of greater thickness has been disclosed as extending from the first bicuspid to the second molar, a somewhat shorter portion of greater thickness could be employed, for example not extending over the first bicuspid or over the second molar, so long as the thicker portion is provided in the molar-bicuspid region. Further, while the mouthguard is primarily intended for use on the upper teeth, and it is expected that it would be so used in essentially all cases, it could be adapted for use on the lower teeth if that should be necessary for a particular prospective user. It is intended, therefore, by the appended claims to cover all such modifications as come within the spirit and scope of this invention.

It is claimed:

1. A mouthguard comprising:

(a) a member formed of a resilient material and having an approximate U-shape corresponding generally to the shape of the arch of the upper jaw;

(b) said member having a bottom wall and spaced inner and outer flanges extending upwardly therefrom, forming a cavity for receiving the upper teeth;

(c) said bottom wall having a bottom surface substantially flat laterally and being of greater width than the width of the lower teeth so as to extend laterally across the full width of the lower teeth;

(d) said bottom wall being formed in an anterior-posterior direction to include over the length of each molar-bicuspid region a portion of greater thickness than the remainder of said bottom wall for minimizing potential shock resulting from a blow to the lower jaw, said bottom surface of said bottom wall having an even surface curved in the anterior-posterior direction over said thickened portions in each said molar-bicuspid region.

2. The mouthguard of claim 1 wherein the lower surface of said portion of greater thickness follows approximately the Curve of Spee.

3. The mouthguard of claim 1 wherein the lower surface of said portion of greater thickness is shaped so said portion initially contacts the lower teeth in the area of the lower first molar and the lower jaw pivots about said area.

4. The mouthguard of claim 1 wherein said portion of greater thickness extends from the first bicuspid to the second molar.

5. The mouthguard of claim 1 wherein said portion of greater thickness has its maximum thickness in the area which engages the lower first molar.

6. The mouthguard of claim 1 wherein the anterior portion of said bottom wall is recessed upwardly to provide a space between said anterior portion and the lower incisors.

7. The mouthguard of claim 6 and further including a depending tab on said anterior portion for engaging the lower incisors to facilitate proper positioning of the mouthguard during fitting.

8. The mouthguard of claim 6 wherein (a) said portion of greater thickness is approximately 5 mm thick in the area which engages the lower first molar and is approximately 4 mm thick in the remainder of said portion; and (b) said anterior portion of said bottom wall is approximately 2 mm thick.

9. The mouthguard of claim 1 wherein said mouthguard comprises an outer shell of resilient material and an inner layer of deformable material in said cavity, said deformable material being adapted to be impressed by the upper teeth and to conform thereto.

10. The method of protecting the teeth and head from injury resulting from a blow to the lower jaw which comprises the steps of:

(a) providing an approximately U-shaped member of resilient material having a bottom wall and spaced inner and outer flanges forming an upwardly directed cavity conforming generally to the shape of the arch of the upper jaw, said bottom wall being formed in an anterior-posterior direction to include over the length of each molar-bicuspid region a portion of greater thickness than the remainder of said bottom wall and having a positioning tab depending downwardly from the anterior portion thereof;

(b) positioning the mouthguard on the upper jaw with the upper teeth received in said cavity;

(c) closing the lower jaw until said thickened portions are engaged by the lower molar-bicuspid teeth and said tab is engaged by the lower incisors and the upper teeth are impressed into the material of said cavity; and (d) removing said positioning tab from said U-shaped member.

11. The method of claim 10 wherein said member includes an inner layer of deformable material in said cavity and the upper teeth are impressed into said layer of deformable material during step (c).

* * * * *